United States Patent [19]

Carlson

[11] 4,119,201

[45] Oct. 10, 1978

[54] CONTAINER INCORPORATING PARTIALLY OPENED PROTECTIVE END CELLS

[75] Inventor: Frank A. Carlson, Bridgeview, Ill.

[73] Assignee: Alton Box Board Company, Alton, Ill.

[21] Appl. No.: 759,388

[22] Filed: Jan. 14, 1977

[51] Int. Cl.[2] ..... B65D 85/54

[52] U.S. Cl. ..... 206/424; 229/40

[58] Field of Search ..... 206/424; 229/40, 14 C

[56] References Cited

U.S. PATENT DOCUMENTS

| | | | |
|---|---|---|---|
| 3,055,574 | 9/1962 | Johnson | 229/40 |
| 3,485,435 | 12/1969 | Greene | 229/40 |
| 3,720,366 | 3/1973 | Martin | 229/40 |
| 3,885,729 | 5/1975 | Rous | 229/40 |

FOREIGN PATENT DOCUMENTS

| | | | |
|---|---|---|---|
| 816,545 | 7/1969 | Canada | 206/424 |
| 820,134 | 8/1969 | Canada | 206/424 |
| 1,536,301 | 1/1970 | Fed. Rep. of Germany | 206/424 |

*Primary Examiner*—Herbert F. Ross

*Attorney, Agent, or Firm*—Paul M. Denk

[57] ABSTRACT

In a container for use in protecting articles, such as books, a one piece blank is formed to incorporate a pair of main panels, one each for encompassing the upper and lower portions of the article, with said main panels having side panels that may be folded into closure, one superimposed upon the other, and adhered together, so as to form closure at least at these lateral locations; a reentry flap is foldably connected along a score line with one end of each main panel, with the reentry flap being folded into contiguity, after a 180° turn against the interior wall of one of the main panels, and each said reentry flap having a second or end flap foldably connected thereto and disposed at a normal so as to provide end closures for the container.

In another embodiment, one of the main panels is formed into two parts and which two parts may be folded in overlap style, one partially upon the other, so as to provide closure upon the upper portion of the enclosed article. The container, and more particularly its reentrant and end flaps, form open end cells at each end of the container, which insure protection against damage to the ends of any article or book enclosed within the same.

8 Claims, 6 Drawing Figures

CONTAINER INCORPORATING PARTIALLY OPENED PROTECTIVE END CELLS

BACKGROUND OF THE INVENTION

This invention relates generally to a container, and more particularly pertains to a one-piece blank formed book wrap that structurally produces partially opened fully protective end cells for the book enclosed therein.

Numerous styles of book wraps have become available in the art, and more particularly these prior art book wraps are designed to furnish various types of protective cells around the periphery, namely, the spline, lips, and upper and lower ends of the book so as to protect these portions that are normally prone to sustain damage, but more specifically, the prior art type of wraps have included end cells having upper and lower enclosed ends predominantly. Usually these style of book wraps not only incorporate reentry means for shaping the design of the cell, but also include overlying flaps that form complete closure to the end cell itself. Such convenience in book wraps is desirable when one prefers a deluxe style of wrap that utilizes a much greater quantity of paperboard in the formation, and such package for books are shown in the prior art U.S. patents, to Boitel, U.S. Pat. Nos. Re. 25,856; 3,289,824; and 3,325,964. As can be seen, the end cushions for these style of prior art paperboard containers are formed from a variety of inner flaps that are hinged together to provide the structural arrangement for an end cell, and then require the disposition of an outer series of panels that form closure to the shown packages.

Of more recent origin are the variety of angled cushioned shipping folders as invented by Carpenter, and as disclosed in the U.S. Pat. Nos. 3,722,668, 3,768,721, and 3,792,811. These particular folders utilize internally arranged flaps or panels that provide interior structure supports about which outer panels or flaps may be secured, also for providing closed formation for their reinforced end cells.

Similar type end closures for cartons are disclosed in the various United States patents that have issued to Rous, and which are equivalent to the structure of the aforesaid Carpenter patents, generally disclosing internal flap structure that is foldably interconnected and then covered by an outer flap to form a closed end cell at either end of the book carton. This is shown in the U.S. Pat. Nos. 3,722,783; Re. 28,460; and 3,986,608.

What is important to note in these aforesaid prior art patents is that the internal structure of flaps and panels that form initially the end cells for their cartons are not capable in and of themselves to function independently as a protective feature of the enclosed books without cooperating with an outer covering of various panels or flaps, as shown in most of these patents, and therefore, by necessity, are constructed in the formation of closed end cells to enhance protection of articles particularly at their upper and lower ends. The current invention, to the contrary, forms protective end cells, albeit open end cells, from a single pair of arranged flaps, at either end of the container, and therein furnish the all necessary structural reinforcement and protective covering at these locations for preventing damage to the ends of the contained book. Any, by necessity, containers formed in this manner utilize less material in the formation of their protective end cells than those that are formed having structure that provides full end cell closure.

It is, therefore, the principal object of this invention to provide an open end cell container at either of its ends for protecting books or other articles.

Another object of this invention is to provide a container for a book or other article and which incorporates partially opened protective cells at either of its ends, and which cells may be either arranged opened to the same or opposite sides of the container.

Another object of this invention is to provide a jointed container and which is formed from a minimum of folds in furnishing a full overlap for a book or other article contained therein.

A further object is to provide a jointed container that can accommodate objects such as books of equivalent length and width and having a small variable change in thickness.

Another variation upon this invention is the formation of a container for books and which incorporates partially opened end cells at either of its ends, and which is joined together at approximately the location of the midpoint of any article contained therein.

A further object of this invention is to provide an integral blank for an article container which is formed from a minimum of paperboard material and enclosed by a single glue or tape joint.

These and other objects will become more apparent to those skilled in the art upon reviewing the summary of this invention, and upon undertaking a study of its preferred embodiment in view of its drawings.

SUMMARY OF THE INVENTION

This invention forms a container for a book or other article from a blank that incorporates a pair of main panels, which main panels have hingedly connected to one or both of their ends sets of combined reentrant and end flaps, with the reentrant flaps being folded back approximately 180° contiguously against one of the panels, and the end flaps being arranged at a normal, or approximately perpendicularly therefrom, so as to form end closure for the container. The second main panel is folded over to provide closure for the other side of the encased article, and then the free end of the said second panel and the remaining free edge of one of the end flaps are joined by means of a tape joint to insure closure for the container. Side panels are arranged along each edge of the said main panels, and are folded into closure, generally superimposed one upon the other, as on each side of the container, so as to insure closure at these locations, with certain of the side panels having extensions therefrom, approximating the length of the reentrant panel, so as to insure the formation of a partially opened end cell, at each end of the container, to furnish protection for any article encompassed therein.

In certain embodiments of the container the end cells are formed in a manner that dispose their openings towards the same side of the container, while in another embodiment these end cells may be arranged oppositely with respect to each other so that their openings face diametrically of one another.

In a further embodiment for this invention the second main panel is actually formed of two parts, with each part of the second main panel being adhered to opposite ends of the combined reentrant and end flaps formed to either end of the first main panel, so that when these flaps are folded over and arranged in the manner as previously described, the two parts of the second main panel may be folded down into an overlying relationship against any article, such as a book contained within the container, being generally arranged in a parallel position with respect to the first main panel, and with its side panels being folded down into closure, furnishing complete coverage for the book encased therein.

In certain of the embodiments of this container, it is prepared in blank form, and the container may be initially folded over at convenient locations so as to dispose one end edge of its second main panel into contiguous proximity with respect to the free end edge of one of the end flaps, and a tape adhered thereto so as to form a jointed container that is pre adhered prior to blank shipment so that it may then be conveniently snapped open into the tubular form upon machinery as when a book is slid therein under a side loading operation, as when forming container coverage in preparation for shipment of the said book.

DESCRIPTION OF THE PREFERRED EMBODIMENT

Figure 1:
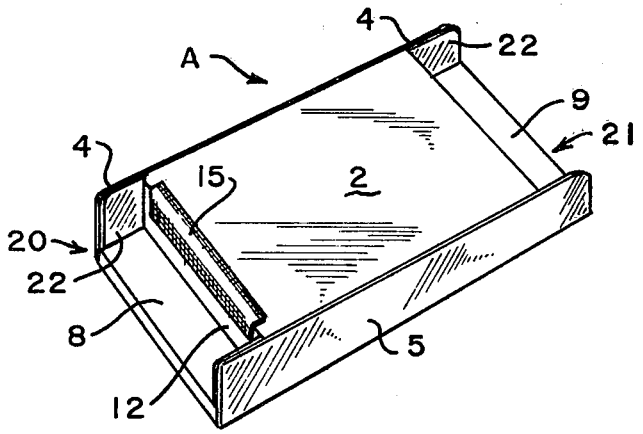
FIG. 1 discloses an isometric view of a jointed container of this invention disclosing partially opened end cells opening towards its same side.
Figure 2:
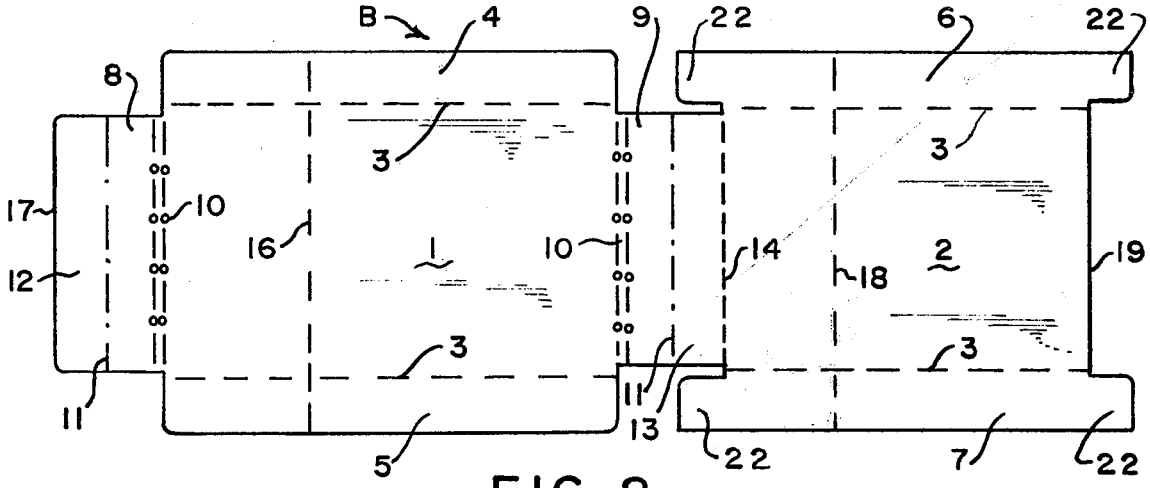
FIG. 2 discloses a one piece blank for the container as shown in FIG. 1.

In referring to the drawings, and in particular FIGS. 1 and 2, there is disclosed a container A which is formed from the blank B, said blank being of a unitary and one piece configuration that can be easily stamped from a segment of paperboard. The container includes a series of main panels, namely, the first main panel 1 and a second main panel 2 each of which has foldably connected, as along the fold lines 3, the side panels 4, 5, 6 and 7, respectively, which form the side closures for the container when folded into its book wrapping configuration, as shown in FIG. 1. Connecting at each end of the main panel 1 are the reentrant flaps 8 and 9, and which are folded back 180° so as to provide for their disposition in contiguity against the inner surface of the main panel 1, and to facilitate such a fold a double reverse slit score line, as at 10, is furnished proximate the juncture of these re-entrant flaps to the panel 1. Foldably connecting as along the crease lines 11 are the end flaps 12 and 13, and which are designed for being arranged perpendicularly with respect to their connected reentrant panels 8 and 9, respectively, one as shown in this disposition in FIG. 1. The end flap 13 associated with the reentrant flap 9 to one end of the panel 1 is integrally connected as along a fold line 14 with the panel 2.

To facilitate the usage of this container blank when automatically set up upon machinery for use in the side loading of books within its interior, the blanks may be partially formed as jointed containers as shipped, so that the user of the container need not be concerned with the effectiveness of such a formed tape joint, as shown at 15, for use in the securement of the container snugly around any book enclosed therein during its mailing and transport. Obviously, the most effective way to attain such a tape joint is by arranging the free end oppsite edges of the blank into juxtaposition so that when the tape 15 is applied it will insure a tight seal between the proximate blank free edges. For example, the left side of the blank, as shown in FIG. 2, is folded over proximate the fold line 16, which fold line is arranged approximately one fourth the length of the blank from the free end edge 17, while the opposite, or right hand edge of the blank, is folded over along its fold line 18, so as to dispose its proximate free end edge 19, contiguously against the previously defined edge 17. Then, a length of tape, just short of the width of the container, may be applied across these contiguous free edges of the blank, thereby pre-forming the tape joint 15, as aforesaid.

The container, when formed into the configuration of a blank, as shown in FIG. 1, disposes a pair of partially opened end cells, as at 20 and 21, at opposite ends of the said container, and in this particular form of container, these end cells, while opening to their ends, also open upwardly towards the second main panel 2, as shown. And, to insure the effectiveness of this end cell in preventing any crushing damage to the ends of any book encased therein, the side panels 4 and 5 are of a length equivalent to the length of the main panel 1, which is further equivalent to the overall length of the container, as shown, and the side panels 6 and 7 joining then the second main panel 2, have extensions, as at 22, at their ends, so as to form a double reinforcement for the side panels even at the location of these end extensions that form part of the end cells 20 and 21. In the formation of the container, the side panels 6 and 7 will be folded over initially, with the side panels 4 and 5 then superimposed thereupon, adhered thereto as by means of a glue, so as to insure protection for any article encased therein by means of a double wall reinforcement.

To achieve removal of any book from the container, the tape joint 15 need only be pulled loose, and the upper panel 2 will pivot open allowing a book to be easily removed from the same.

Figure 3:
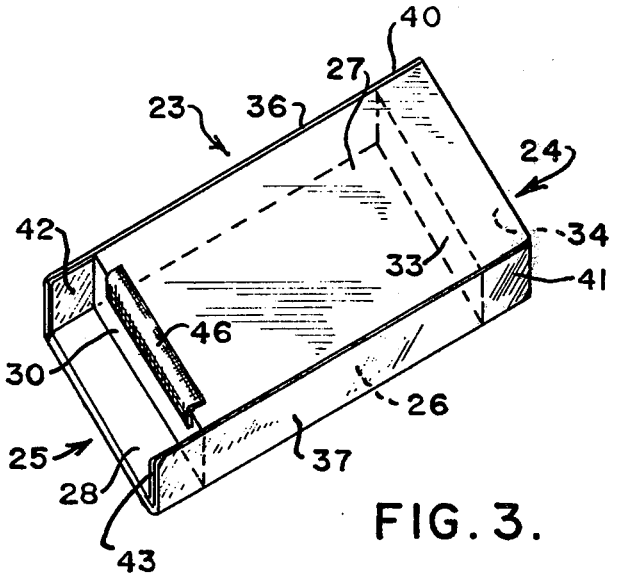
FIG. 3 discloses an isometric view of a modified form of container of this invention, wherein its partially opened end cells face in opposite directions.
Figure 4:
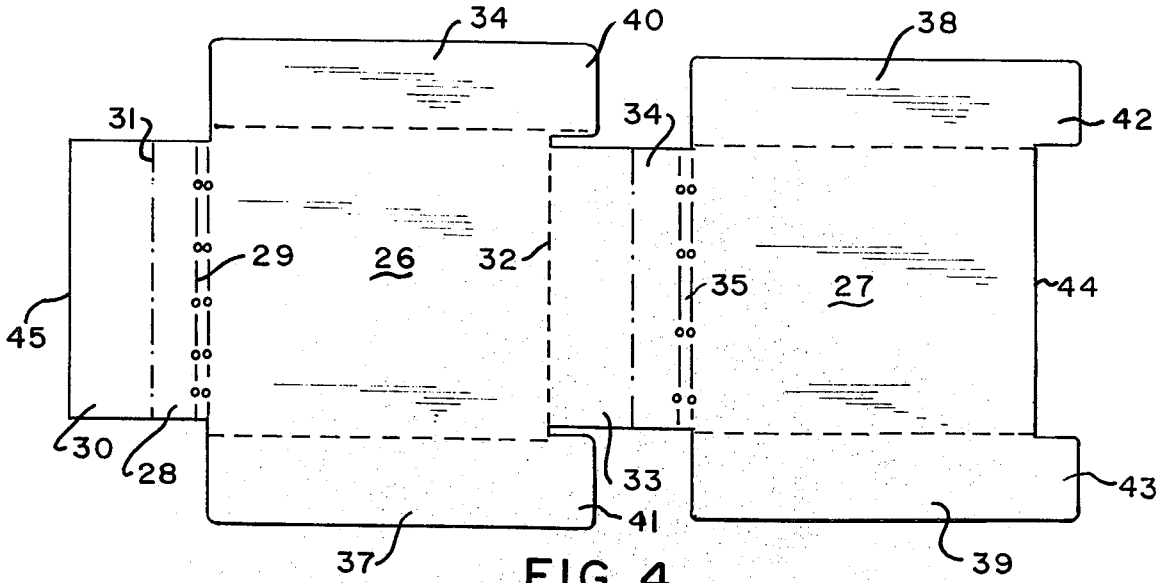
FIG. 4 discloses a blank for the style of container previously shown in FIG. 3.

A modified form of container 23, of the type similar to the type previously defined in FIG. 1, is shown in FIG. 3. The difference between this container, and the one previously explained, with the exception of minor differences in the configuration of its blank, as shown in FIG. 4, is that its partially opened end cells 24 and 25, face in opposite directions with respect to each other. This container is formed also having a main panel 26 and a second main panel 27, with the main panel 26 having a reentrant flap 28 secured to one end, by means of a reverse slit score line 29, with the reentrant flap 28 foldably connecting with an end flap 30, as along the fold line 31. At the opposite end of the main panel 26, it foldably connects along the fold line 32 with another end flap 33, with said end flap 33 foldably connecting with a reentrant flap 34, which latter flap foldably connects by means of the score line 35 to the second main panel 27. The reason for the use of a score line, or double score line, as shown at 29 and 35, is that these reentrant flaps are folded back a full 180° so as to allow for their arrangement in contact against their connected main panel(s), which is performed during the initial formation of the open end cells, as at said 24 and 25. At either side of the main panel 26 is a side panel 36 and 37, while laterally of the second main panel 27 there is foldably provided the side panels 38 and 39, as shown.

Each of these side panels, of this particular container embodiment, has an extension projecting therefrom, such as the extensions 40 and 41, which project from the side panels 36 and 37, respectively, while the extensions 42 and 43 project from the side panels 38 and 39, respectively.

Thus, in the formation of the container 23, as shown in FIG. 3, the main panel 26 rests upon a surface, and its reentrant flap 28 is folded over approximately 180° and into proximity against the inner surface of the said panel 26, while its end flap 30 is turned approximately at a normal, or perpendicularly, from the flap 28. At the same time, the end flap 33 is bent perpendicularly upwardly with respect to the main panel 26, and its reentrant flap 34 is bent outwardly towards the end of the container, with the second main panel 27 then being folded over approximately 180° with respect to said reentrant flap 34, so as to dispose its end edge 44 into proximity with the end edge 45 of the flap 30, where a tape joint 46 may be made. The side panels 38 and 39 may be folded down respectively, to provide side closure for the forming container, while the side panels 36 and 37 may be folded upwardly approximately 90° and superimposed upon the previous panels 38 and 39, and glued along their width, so as to form double reinforcement at the sides of the container. The extensions 42 and 43 of th side panels 38 and 39, respectively, extend to the end of the end cell 25, and with the back edges of the side panels 36 and 37 form a double reinforcement at this location for insuring the rigidity of this partially opened end cell 25. At the same time, the extensions 40 and 41 maintain an overlying relationship with the ends of the side panels 38 and 39, so as to form a double reinforcement at that end cell location. Thus, the formed container provides a partially opened end cell disposed in opposite directions at each upper and lower end of the container, and thereby furnish full protection for any book encased therein yet even accommodates the use of a minimum of paperboard material in the formation of its blank.

Figure 5:
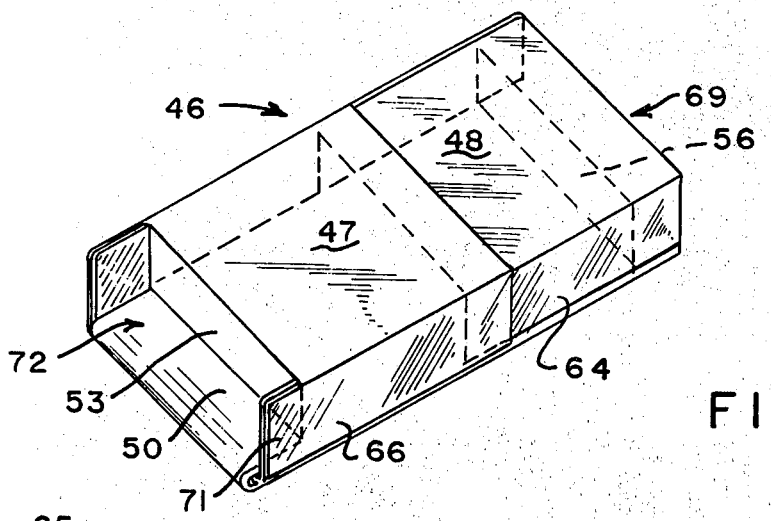
FIG. 5 provides an isometric view of a modified form of container having an upper main panel that is segmented into two parts or components.
Figure 6:
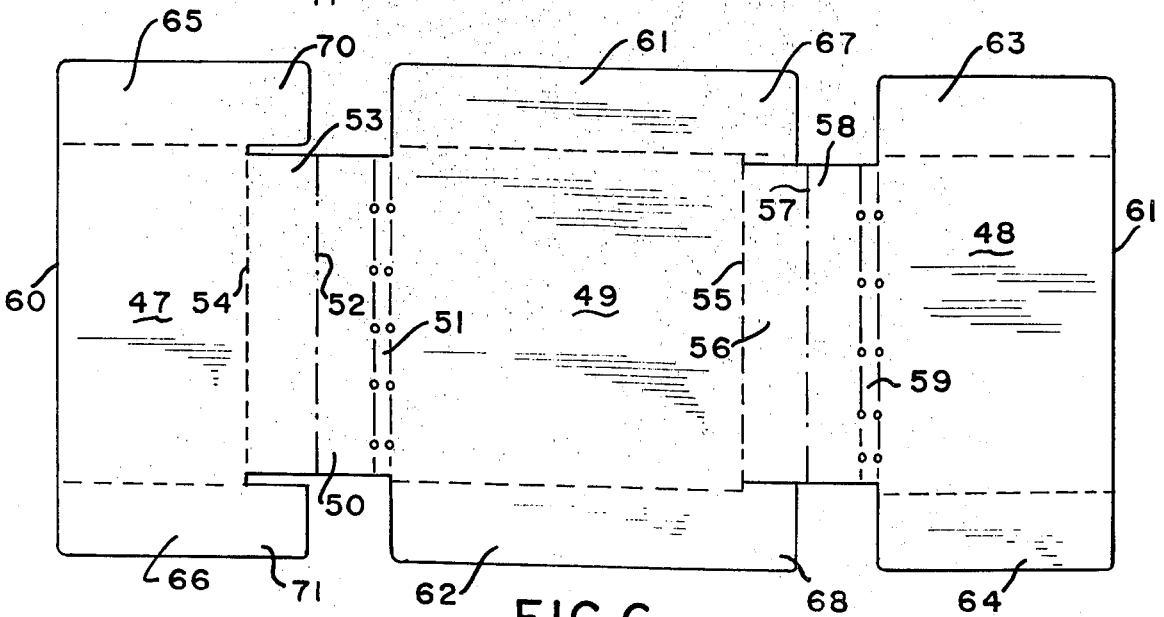
FIG. 6 discloses a blank for the style of container previously disclosed in FIG. 5.

The modified form of container 46, shown in FIG. 5, is similar to the formation of containers previously analyzed, with the exception that this particular container, as shown in its blank form in FIG. 6, provides a second main panel that is formed into two parts, 47 and 48, as shown. The main panel 49 is formed having a reentrant flap 50 that is connected by the score line 51, at its one end, and which reentrant flap 50 secures by means of a fold line 52 with the end flap 53, which flap connects also by means of a fold line 54 with the part 47 of the second panel. At the opposite end of the main panel 49 there is foldably connected to it along the fold line 55 the end flap 56, which in turn is foldably connected along the fold line 57 with the reentrant flap 58, and which reentrant flap connects along the score line 59 with the second part 48 of the second main panel.

In formation of the carton, the main panel 49 rests upon some base, such as machinery, and the reentrant flap 50 is folded over approximately 180°, as shown, with its end flap 53 then being folded upwardly, approximately perpendicularly, and with the second panel part 47 folded downwardly into a parallel relationship with respect to the main panel 49, as can be seen in FIG. 5. Likewise, at the opposite end of the main panel 49, the end flap 56 is folded upwardly approximately 90°, at a normal with respect to a container, and then the reentrant flap 58 is folded outwardly, with the part 48 of the second panel then being folded back 180°, also into a parallel position with respect to the bottom panel 49. The ends 60 and 61 of the panel parts 47 and 48, respectively, are contiguous, or overlap, as shown in FIG. 5, and an adhesive may be applied to these overlapping portions so as to form a glue joint thereat. The main panel 49 contains side panels 61 and 62, foldably connected therewith, and these panels are folded upwardly to provide side closure for the container. In addition, the side panels 63 and 64 foldably associated with the second panel part 48 are folded downwardly into an overlying relationship with respect to the parts of the side panels 61 and 62. Furthermore, the side panels 65 and 66, that are foldably connected laterally of the second panel part 47, are likewise folded downwardly as along their fold lines so as to insure a double reinforcement along the length of the sides of the container 46. The extensions 67 and 68 of the side panels 61 and 62, respectively, extend outwardly a distance beyong the arranged end flap 56, approximately a length equivalent to the length of the reentrant flap 58, and with the contiguous end portions of the side panel 63 and 64 form a double reinforcement at this location of the opened end cell 69 formed at this end of the shown container. Likewise, the extensions 70 and 71 formed integrally projecting from the side panels 65 and 66, respectively, when folded down into overlying relationship upon the side panel 61 and 62, form a double reinforcement with the underlined segments of the said side panels 61 and 62 so as to form a double reinforcement for these particular walls forming the opposite partially opened end cell 72 of the container. Thus, the carton as shown furnishes double paperboard reinforcement at each end of the container which insures a minimizing if not elimination of any damage to the ends of any book enclosed therein. Furthermore, this particular container may be easily opened by a simple pull directed upon the panel part 47 that disengages its adhesive connection with the underlined segment of the panel part 48, which two panel parts form the upper panel for the container, as shown.

Variations in the structure of the container, and modified containers, disclosed and explained in this invention, may occur to those skilled in the art upon reviewing the subject matter of this invention. Such modifications or variations, if within the spirit of this invention, and encompassed by the scope of the claims appended hereto, are intended to be protected by any patent issuing upon this invention. The disclosed embodiments are set forth for illustrative purposes only.

Having thus described the invention what is claimed and desired to be secured by Letters Patent is:

1. A container incorporating partially opened end cells and for use in providing protection for any article enclosed therein, such as a book, comprising, first and second main panels, said second main panel being divided into two parts, side panels connecting to at least one of said main panels, a pair of reentrant flaps, one of each flap connecting to the end of one of said main panels and providing for folded disposition contiguous against the connected main panel, an end flap connecting to each reentrant flap and disposed substantially at a normal to said reentrant flap and thereby providing closure at each end of the formed container, one of said reentrant flap and an end flap being connected together and foldably securing to one end of the first main panel, the other reentrant flap and its connected end flap foldably connecting to the other end of said first main panel, one part of said second main panel being foldably connected to one of said first mentioned connecting reentrant and end flaps, the other part of said second main panel being foldably connected to one of said other connecting reentrant flap and the other end flap, the reentrant flaps being folded contiguously against their respective proximate first and second main panels, the said end flaps being disposed at a normal with respect to their connecting reentrant flaps and providing substantial end closure for any article disposed within the container, said parts of the second main panel being arranged into overlying closure arranged substantially parallel with the said first main panel and thereby providing closure for any article disposed within the formed container, said side panels being folded into a side closing relationship of the container, each side panel having extensions provided at least at one end, and each extension with its connecting side panel having an overall length equivalent to the length of one of said main panels to thereby form a protective and partial end cell at each end of the said formed container.

2. The invention of claim 1 wherein said formed partial end cells at each end of the container opening in the direction of the same main panel.

3. The invention of claim 1 wherein said formed partial end cells at each end of the container opening in opposite directions.

4. The invention of claim 1 wherein one of said reentrant flaps connects with one end of the said first main panel and being turned for disposition contiguous against the said connected first main panel, its connecting end flap being disposed substantially at a normal with respect to said reentrant flap, one part of said second main panel being connected to said end flap and being turned into parallel disposition with respect to the first main panel, the other end flap being foldably connected to the opposite end of said first main panel and being disposed at a normal with respect thereto, the other reentrant flap foldably connecting to the said other end flap being arranged at a perpendicular with respect thereto, the second part of said second main panel being foldably connected to said other reentrant flap, said reentrant flap being arranged contiguous against said other second part, and said other second part being disposed parallel with the said first main panel, and the side panels connecting to the side edges of the first main panel being disposed at a perpendicular with respect thereto so as to provide side closure for the formed container.

5. The invention of claim 4 and including side panels also connecting to the side edges of each part of the second main panel, and said side panels being arranged superimposed upon the side panels of the first main panel so as to provide a double reinforcement at the side location of the said formed container.

6. A container incorporating partially opened end cells and for use in providing protection for any article enclosed therein, such as a book, comprising, first and second main panels, side panels connecting to each side edge of the said first and second main panels, a pair of reentrant flaps, one of each flap connecting to the end of one of said main panels and providing for folded disposition contiguous against the connected main panel, an end flap connecting to each reentrant flap and disposed substantially at a normal to said reentrant flap and thereby providing closure at each end of the formed container, at least the side panels connected to one of the main panels having aligned extensions provided at least at one end, each extension with its connecting side panel having an overall length longer than the length of at least one of said main panels, the side panels connecting to the main panels at each side of the container being folded and adhered into superimposition with respect to each other to provide a side closing relationship upon the container and therein form a doubly reinforced side panel and end cells for the formed container, and each formed end cell being open at the ends of the container and also being opened towards one of the first and second main panels.

7. The invention of claim 6 wherein each formed partially opened end cell at each end of the container has one of its openings arranged towards the same main panel, and at least one of the reentrant flaps and its contiguous main panel extending approximately the width between the side panels of the container.

8. The invention of claim 6 wherein a formed partially opened end cell at one end of the container opens towards one main panel, and the formed partially opened end cell at the other end of the container opens towards its other main panel, and the reentrant flaps and contiguous main panels at each end of the formed container extending approximately the width between the side panels of the formed container.

* * * * *